US005515796A

United States Patent [19]

Ogle et al.

[11] Patent Number: 5,515,796

[45] Date of Patent: May 14, 1996

[54] MATTRESS SEWING AND HANDLING APPARATUS

[75] Inventors: Steven E. Ogle, Carthage, Mo.; Raymond D. Swaney, Galena, Kans.; Michael L. Shelton, Diamond, Mo.

[73] Assignee: L&P Property Management Company, Chicago, Ill.

[21] Appl. No.: 209,221

[22] Filed: Mar. 11, 1994

[51] Int. Cl.[6] ..... D05B 11/00; B65G 47/252

[52] U.S. Cl. ..... 112/2.1; 198/403

[58] Field of Search ..... 112/2, 2.1, 121.23, 112/121.29, 152, 262.3, 304, 308, 322, 217.1; 198/403, 404

[56] References Cited

U.S. PATENT DOCUMENTS

| | | | |
|---|---|---|---|
| 1,322,842 | 11/1919 | Sutton | 112/2.1 |
| 2,869,493 | 1/1959 | Seavert | 112/2.1 |
| 2,976,828 | 3/1961 | Kalning et al. | 112/2.1 |
| 3,083,654 | 4/1963 | Cash, Sr. | 112/2.1 |
| 3,490,061 | 1/1970 | Docker | 112/2.1 |
| 3,664,280 | 5/1972 | Redman et al. | 112/2.1 |
| 4,043,282 | 8/1977 | Fanghanel | 112/2.1 |
| 4,793,463 | 12/1988 | Kane | 198/403 |
| 4,821,656 | 4/1989 | Dordi et al. | 112/2.1 |
| 4,905,615 | 3/1990 | Pofferi | 112/2.1 |
| 4,958,579 | 9/1990 | De Weers | 112/2.1 |
| 5,367,968 | 11/1994 | Diaz | 112/2.1 X |

FOREIGN PATENT DOCUMENTS 8800505 6/1964 Netherlands .

*Primary Examiner*—Ismael Izaguirre
*Attorney, Agent, or Firm*—Wood, Herron & Evans

[57] ABSTRACT

Apparatus including a mattress support for supporting a mattress lying on a first major face or panel thereof and conveying the mattress as a sewing operation, such as an edge sewing and taping operation, is performed with respect to the first major face. A mattress flipping mechanism is provided and may include a pivoting support portion of the mattress support connected to a powered lift mechanism. In one preferred embodiment the mattress support includes a split conveyor and the pivoting support portion of the mattress support is disposed within the space defined between adjacent belts of the split conveyor. Mattress elevating units are provided to create slack in the top panel of the mattress for easier grasping by the operator during a sewing operation. A mattress guide arm is provided for holding the mattress down during the sewing operation. A sewing machine base is pivoted and connected to a fluid powered cylinder for moving the sewing machine away from the mattress support while flipping the mattress. The mattress guide arm is provided with pivoting features for this reason as well.

37 Claims, 6 Drawing Sheets

MATTRESS SEWING AND HANDLING APPARATUS

BACKGROUND OF THE INVENTION

The present invention generally relates to apparatus for sewing and handling mattresses or other cushion structures and, more particularly, relates to apparatus for sewing the top and bottom panels of a mattress or cushion to the side panels thereof while reducing the time and operator effort usually associated with such a sewing operation.

Specialized edge sewing and taping machines stitch the peripheral edges of upper and lower panels of a mattress or cushion to the side panels thereof. Generally, a mattress is moved along a table or mattress support by a conveyor belt that conveys the mattress past a sewing head mounted adjacent the table or support. With current apparatus of this type, the operator stands next to the sewing machine and must firmly compress the mattress to create slack in the fabric panels or shell and continuously pull an edge of the relative upper major face panel together with an edge of a side panel while guiding the mattress into the sewing head. As the operator feeds the mattress into the sewing head, a narrow covering strip is laid over the seam by a suitable feed mechanism and is sewn simultaneously with the seam. The strip covers the seam to create aesthetically acceptable upper and lower edges around the periphery of the mattress.

Mattress edge sewing and taping operations have generally required great manual effort due not only to the size and weight of the mattress but also to the constant compression that the operator must apply to the top of the mattress as well as the simultaneous tension that the operator must apply to the panels as mentioned above. It will be appreciated that large mattresses are especially cumbersome and awkward to manipulate and handle by hand. This has been a special concern in the past when sewing the corners of the mattress which require extra handling and guidance efforts on the part of the operator. Certain improvements have been made in this regard to ease the effort necessary by the operator. For example, one known mattress and cushion sewing device includes a mattress pivoting mechanism and suitable sensors for detecting the corners of the mattress and pivoting the mattress. When a corner is detected, the pivoting mechanism turns the mattress as the sewing head continuously sews around the corner.

Also, when one peripheral edge is sewn and taped it has been necessary for the operator or operators to manually flip the mattress over to sew and tape the other peripheral edge. Typically, a two table system has been used with the tables placed end-to-end and each table having a separate sewing head. When the first edge is finished using the first table and sewing head, the mattress is conveyed to a space between the two sewing heads and then manually flipped over before being sewn and taped by the sewing head on the second table.

It will be appreciated, therefore, that known sewing and taping apparatus continue to have disadvantages associated with the great amount of manual effort as well as the costs and space necessary with prior systems. There is thus still a need for improvements in the art which further reduce the manual labor and effort necessary while sewing and taping the edges of a mattress or cushion. Moreover, there is a need for a mattress sewing and handling apparatus which facilitates more accurately sewn and taped edges, requires less space, and costs less than past apparatus.

SUMMARY OF THE INVENTION

It has therefore been one object of the invention to provide a powered mattress flipping mechanism which eliminates the need to manually flip a mattress during edge sewing and taping operations.

It has been another object of the invention to more fully automate the flipping operation by moving the sewing head away from the mattress before flipping.

It has been another object of the invention to eliminate one table and one sewing head of a traditional two table and two sewing head system.

It has been another object of the invention to provide a mechanism for creating slack in the top and side panels of the mattress as the mattress moves past the sewing head so that the operator can easily pinch the panels together while feeding them into the sewing head.

It has been another object of the invention to eliminate the need for the operator to apply constant compression to the mattress top during the sewing operation.

It has been a further object of the invention to provide a mattress guide arm which is movable between an engaged position for guiding the mattress during a sewing operation and a disengaged position for allowing the mattress to be flipped over.

To these ends, the present invention comprises apparatus including a mattress support for supporting a mattress lying on a first major face or panel thereof while a sewing operation, such as an edge sewing and taping operation, is performed with respect to the first major face. The mattress support includes at least one powered conveyor operatively connected to the mattress support for conveying the mattress past a sewing head or sewing machine. In the preferred embodiment, the mattress support further includes a pivoting support portion for flipping the mattress after the sewing operation is performed with respect to the first major face or panel to allow a sewing operation to be performed with respect to the second major face or panel of the mattress.

In the preferred embodiment the conveyor includes a split conveyor including first and second adjacent conveyors operatively connected to the mattress support. A space is left between adjacent conveyor belts of the split conveyor and the pivoting support portion of the mattress support is disposed within the space. The pivoting support portion is pivotally connected to the mattress support at one end and connected to a powered lift mechanism at the opposite, free end. The end of the mattress disposed over the free end of the pivoting support portion may thereby be moved in an upward direction until the mattress is flipped from one major face onto the other. The split conveyor is preferably an upstream conveyor and the apparatus further includes a downstream conveyor.

A sewing head or sewing machine is mounted along one side and substantially between the upstream and downstream conveyors. The sewing machine is pivotally mounted to a base such that it may be pivoted toward the conveyor into an operating position for sewing a mattress or pivoted away from the conveyor into a mattress flipping position which allows sufficient space for flipping the mattress. A fluid powered cylinder is used to pivot the sewing machine between the operating and flipping positions.

In a second embodiment upstream and downstream conveyors are placed end-to-end as in the first embodiment, however, in place of a pivotal support portion of the upstream conveyor the outer ends of both the upstream and the downstream conveyor are raised and the mattress is flipped over while being transferred from the downstream conveyor to the upstream conveyor. Preferably, the powered lift mechanisms for raising the pivotal support portion of the first embodiment as well as the lift mechanisms for raising the conveyors of the second embodiment comprise hydraulic or fluid powered cylinders.

In a further aspect of the invention the mattress sewing and handling apparatus includes at least one mattress elevating mechanism mounted between the upstream and downstream conveyors at a location that positions the elevating mechanism proximate the edge of the mattress opposite to the edge being sewn. The elevating mechanism raises a portion of the mattress and creates slack in the top panel so that the operator can easily pinch the top and side panels together while feeding edges thereof into the sewing head.

Specifically, the elevating mechanism comprises an endless belt member mounted for vertical and rotational movement in the space created between the upstream and downstream conveyors. The endless belt is operatively connected to a rotatable drive member which may be connected to the same drive that drives either or both of the upstream and downstream conveyors. To provide for vertical movement of the endless belt and therefore the mattress, the endless belt extends around at least one vertically movable roller connected to a vertical drive mechanism. Preferably, multiple elevating mechanisms are provided at a plurality of predetermined spaced locations between the upstream and downstream conveyors. This facilitates optimum elevation of different sized mattresses and of mattresses having significantly different length and width dimensions such as standard twin sized mattresses.

The mattress sewing and handling apparatus further includes a mattress pivoting side arm or rail and suitable sensors for turning the mattress as a corner is taped and sewed by the sewing head. In accordance with the present invention the pivoting arm includes a mattress guide arm connected along a top edge thereof and movable between an engaged position in which the guide arm contacts an upper major face of the mattress and a disengaged position spaced away from the mattress a distance sufficient to allow the mattress to be flipped over.

Further objects and advantages of the present invention will become more readily apparent upon review of the following detailed description of the preferred embodiments taken in conjunction with the accompanying drawings.

BRIEF DESCRIPTION OF THE DRAWINGS

FIG. 1A is an enlarged detail of the area 1A of FIG. 1;

DETAILED DESCRIPTION OF THE PREFERRED EMBODIMENTS

Figure 1:
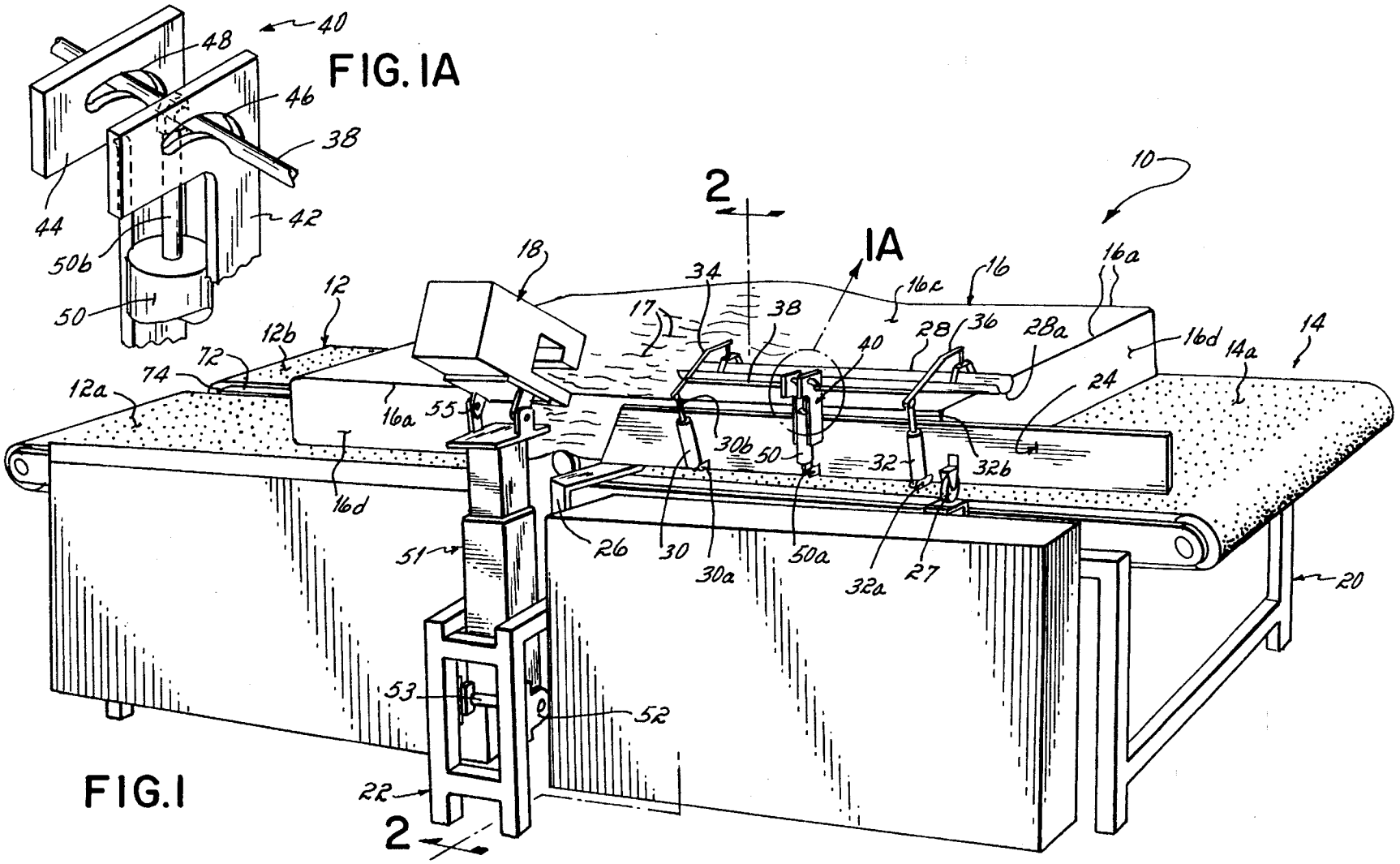
FIG. 1 is a diagrammatic perspective view of an apparatus constructed in accordance with a preferred embodiment of the invention.

As shown in FIG. 1, an apparatus 10 constructed according to a preferred embodiment of the present invention includes a split upstream conveyor 12 having side by side powered conveyor belts 12*a*, 12*b*. Apparatus 10 also utilizes a downstream conveyor 14 which need not be a split conveyor but instead may comprise a single powered conveyor belt 14*a* approximately equal in width to the combined width of belts 12*a*, 12*b*. For purposes of illustration, belts 12*a*, 12*b* and 14*a* move from left to right with respect to FIG. 1. Conveyors 12, 14 support a mattress 16 lying on either major face thereof as they move mattress 16 past a sewing machine 18 which tapes and sews a relative upper peripheral edge 16*a* of mattress 16. The sewing components of sewing machine 18 as well as the tape or covering strip feed mechanism may be conventional and details thereof will therefore not be discussed or shown herein. Conveyors 12, 14 are mounted for operation to a table comprising a support frame 20 while sewing machine 18 is mounted for operation between conveyors 12 and 14 on a frame 22 which is rigidly affixed to frame 20 as by welding.

As further shown in FIG. 1, a side rail 24 helps to guide mattress 16 as upper edge 16*a* is sewn. Side rail 24 is pivotally attached to frame 20 by a pivoting bracket 26 connected at an inner end thereof. Bracket 26 pivots about a vertical axis to turn side rail 24 about that axis. At an outer end of side rail 24, a caster 27 provides rolling support for pivoting side rail 24. A motor 25 is connected to bracket 26 and serves to turn side rail 24 and mattress 16 around each corner of mattress 16 during a sewing operation. As disclosed in U.S. Pat. No. 4,958,579, which is hereby fully incorporated by reference herein, suitable sensors are used to detect the corners of mattress 16 before motor 25 initiates the turn.

The Mattress Guide Arm

In accordance with the present invention, a guide arm 15 28 is operatively connected along an upper edge of side rail 24 for movement between a mattress engaging position and a mattress flipping position. Specifically, guide arm 28 includes a lower mattress engaging surface 28*a* which is convexly shaped and helps to hold the mattress down proximate sewing machine 18. A pair of double acting pneumatic cylinders 30, 32 are pivotally connected at respective lower ends 30*a*, 32*a* to side rail 24. Their respective piston rods 30*b*, 32*b* are pivotally connected to guide arm 28 by way of respective pivot arms 34, 36.

Pivot arms 34, 36 are rigidly affixed to guide arm 28 at their outer ends. A connecting rod 38 is rigidly connected at opposite ends thereof to pivot arms 34, 36. To provide pivoting action of arms 34, 36 in a manner described below, the ends of connecting rod 38 are rigidly affixed to the respective pivot arms 34, 36 at locations spaced equal distances inwardly of the pivotal connection made between the respective piston rods 30*b*, 32*b* and each pivot arm 34, 36.

As shown best in FIGS. 1 and 1A, a central bracket 40 is rigidly affixed to side rail 24 and includes two spaced apart plate portions 42, 44 having respective curved slots 46, 48 through which connecting rod 38 extends. Slots 46, 48 each have an identical radius of curvature equal to the distance that connecting arm 38 is spaced inwardly of the pivotal connection made between the respective piston rods 30*b*, 32*b* and each pivot arm 34, 36 as mentioned above. A third double acting pneumatic cylinder 50 is pivotally connected to bracket 40 at a lower end 50*a*. As better shown in FIGS. 2 and 3, piston rod 50*b* of cylinder 50 is pivotally connected at an upper end thereof to connecting rod 38.

Figure 2:
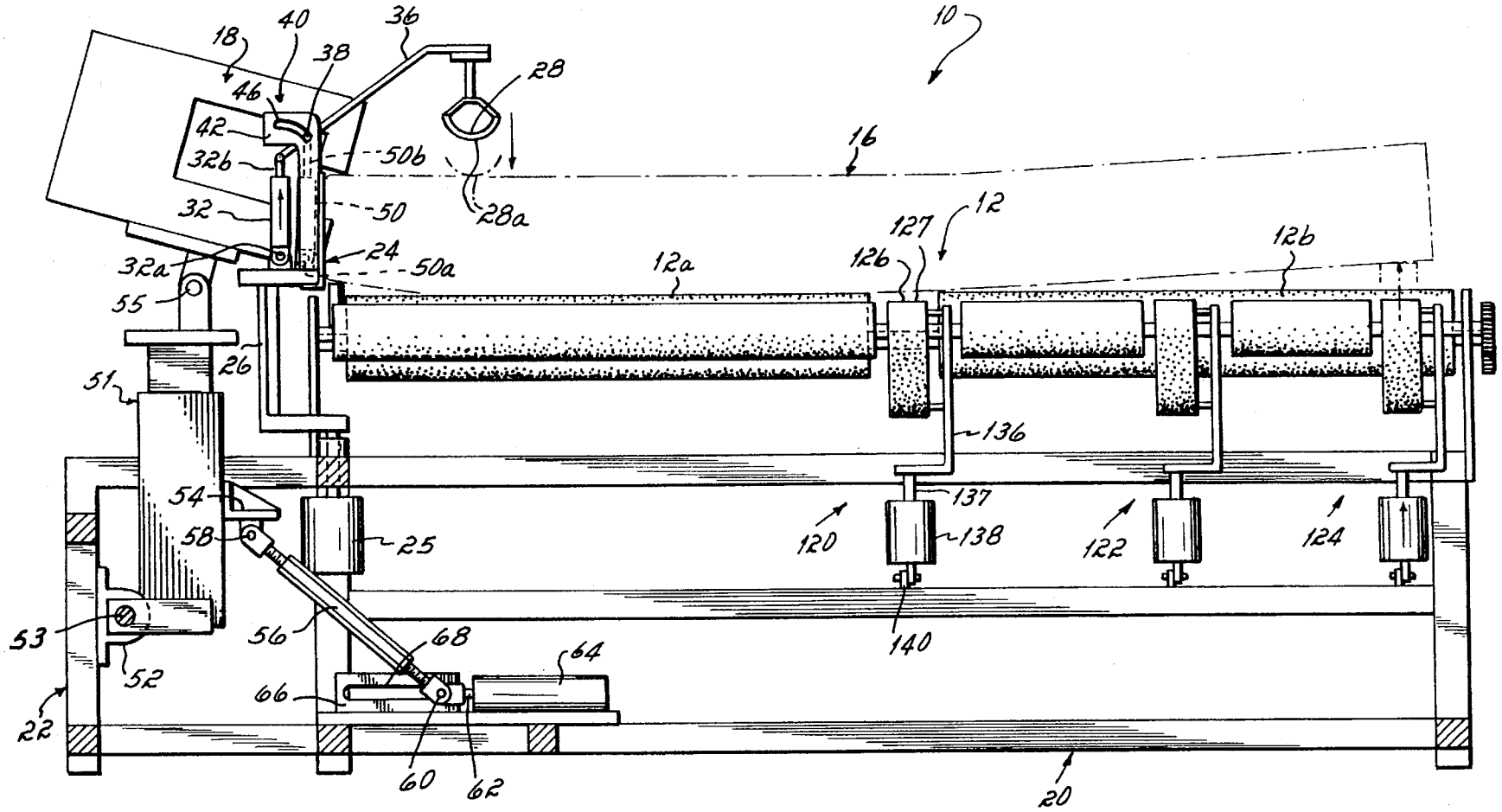
FIG. 2 is a cross sectional view of the apparatus taken along line 2—2 of FIG. 1 and diagrammatically showing the sewing machine and guide arm in an engaged or operating position.

Referring now to FIGS. 1 and 2, cylinders 30, 32 are used to pivot guide arm 28 about a substantially horizontal axis defined by the axis of connecting rod 38 from a mattress engaging position to an elevated, disengaged position and vice versa as shown by the solid and phantom representations thereof illustrated in FIG. 2. As also shown in FIG. 2, connecting rod 38 is situated at the lowermost end of slots 46, 48 when this pivoting action takes place. Thus, cylinder 50 is retracted in FIGS. 1 and 2 and has pulled connecting rod down to the inner, lower end of slots 46, 48. Engagement and disengagement of guide arm 28 with mattress 16 in the manner illustrated in FIG. 2 allows the operator to selectively apply compression to the upper surface of mattress 16 during desired portions of the sewing process. Such compression is especially desirable during the corner sewing procedure. Compression of mattress 16 as it is being turned by side rail 24 assists in maintaining a high quality taped and sewn seam through the entire corner radius.

Figure 3:
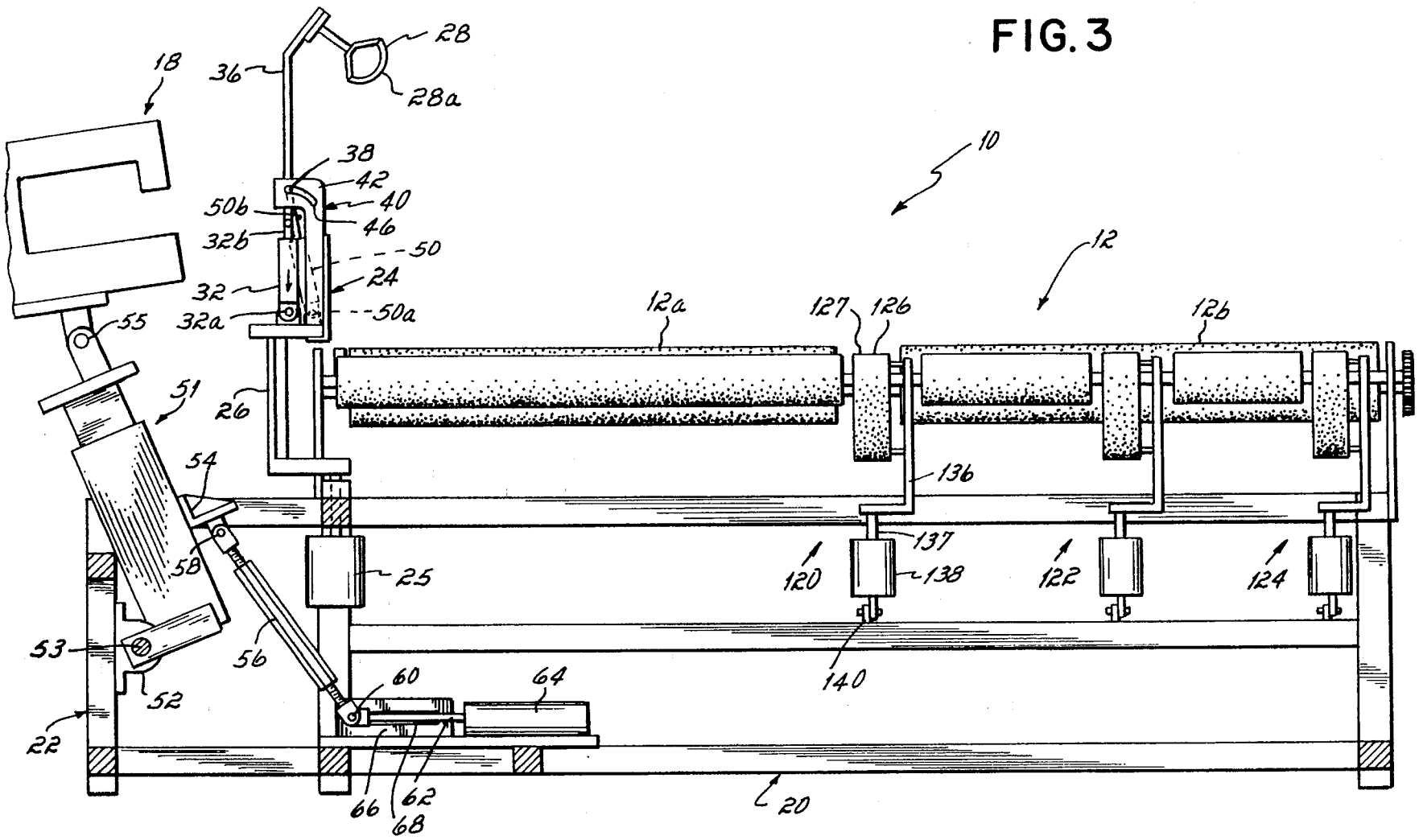
FIG. 3 is a cross sectional view similar to FIG. 2 but showing the sewing machine and guide arm moved to a disengaged or nonoperating position suitable for flipping a mattress.

Referring briefly to FIG. 3, with cylinders 30, 32 each retracted, cylinder 50 is used to raise connecting rod 38 to the uppermost end of slots 46, 48 to prepare for flipping mattress 16 over to sew the opposite edge. Raising connecting rod 38 in this way lifts pivot arms 34, 36 and guide arm 28 to the position shown in FIG. 3 to give sufficient room for the flipping operation, discussed in detail below.

The Pivoting Sewing Machine Support

As also shown in FIGS. 2 and 3, sewing machine 18 is mounted to an adjustable telescoping base 51 by way of a pivot 55 which allows machine 18 to be pivoted in the immediate vicinity of mattress 16. As the adjustment mechanisms used in conjunction with telescoping base 51 and pivot 55 form no part of the present invention, they are neither shown nor described herein. According to the present invention, however, base 51 may be pivoted away from conveyors 12, 14 to allow for a mattress flipping operation to take place. In this regard, a pivot support 52 is rigidly connected to support frame 22 and includes a pivot attachment 53 to a lower end of base 51. Base 51 may therefore pivot about a horizontal axis parallel to conveyors 12, 14 such that base 51 and sewing machine 18 may be moved from an engaged or operating position as shown in FIG. 2 to a disengaged or nonoperating position as shown FIG. 3 allowing sufficient room for flipping a mattress over without obstruction from sewing machine 18.

Sewing machine 18 includes a bracket 54 rigidly secured thereto and facilitating the connection of a length adjustable rod 56 by way of pivot connection 58. Rod 56 is connected at a lower end thereof by a pivot connection 60 to piston rod 62 of a double acting pneumatic cylinder 64. Pivot connection 60 is operatively connected to a guide 66 rigidly affixed to frame 20. More specifically, pivot connection 60 moves along an elongated slot 68 of guide 66. Slot 68 provides support to ensure that piston rod 62 does not have significant lateral loading and to further restrict the lower end of rod 56 to a horizontal path of movement as piston rod 62 is retracted and extended to respectively engage and disengage sewing machine 18 as shown in FIGS. 2 and 3.

The Mattress Flipping Mechanisms

Figure 4:
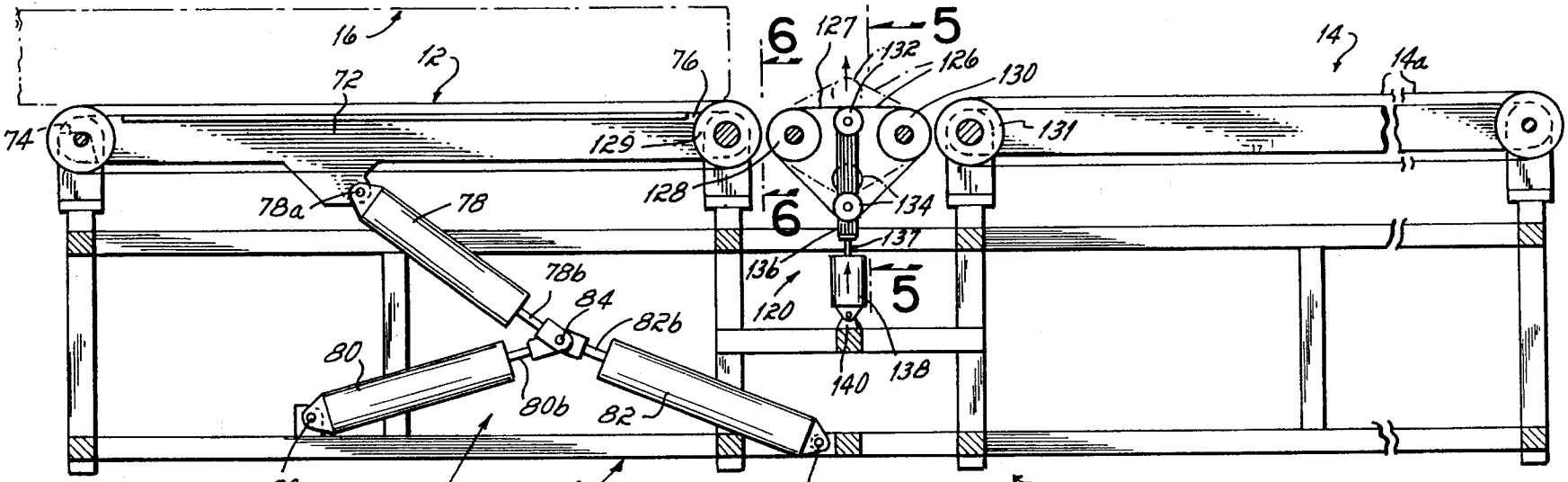
FIG. 4 is a schematic side elevational view of the apparatus of FIG. 1 showing the preferred embodiment of the flipping mechanism as well as the mattress creasing or elevating mechanism of the present invention.
Figure 6:
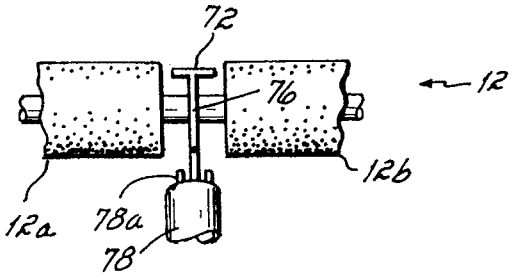
FIG. 6 is a cross sectional view of the apparatus taken along line 6—6 of FIG. 4 and showing the mattress flipping mechanism thereof.
Figure 7:
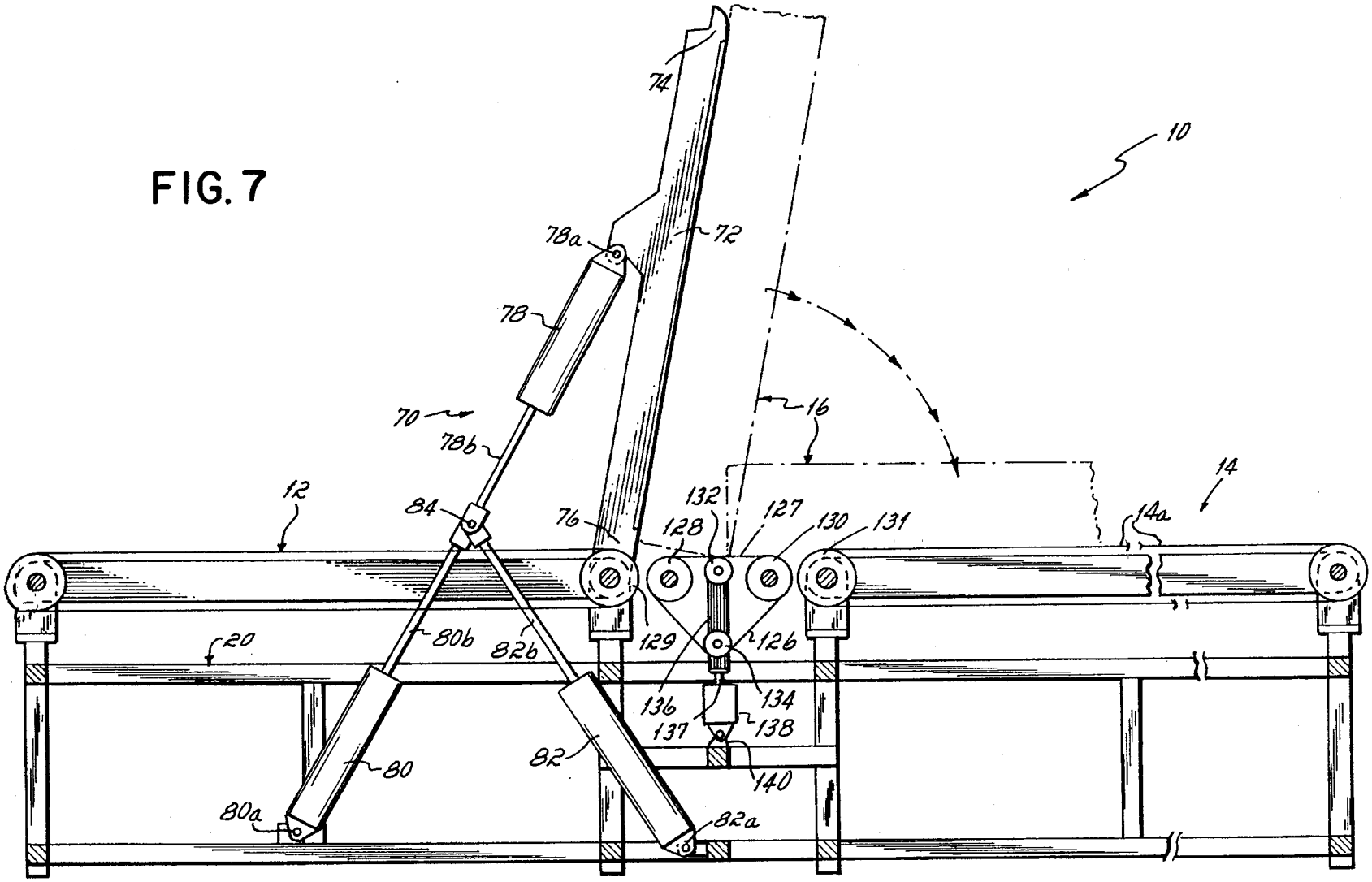
FIG. 7 is a schematic side elevational view similar to FIG. 4 and of the apparatus of FIG. 1 showing the flipping mechanism raised during a mattress flipping operation.

FIGS. 4, 6 and 7 illustrate a mattress flipping mechanism 70 constructed in accordance with a preferred embodiment of the present invention. Specifically, mattress flipping mechanism 70 includes a pivoting support member 72 extending between conveyors 12*a*, 12*b* of split upstream conveyor 12 (FIG. 6). Pivoting support member 72 includes a free end 74 and a pivoting end 76. When support member 72 is in a lowered position as shown in FIG. 4, free end 74 is approximately even with an outer end of conveyor 12 while pivoting end 76 is connected at an inner end of conveyor 12.

Flipping mechanism 70 further includes, for example, three double acting pneumatic cylinders 78, 80, 82 for raising and lowering pivoting member 72. In this regard, cylinder 78 has one end 78*a* pivotally attached to member 72 and a movable piston rod 78*b* at the other end. Cylinders 80, 82 are each pivotally attached at 80*a*, 82*a* to frame 20 and include piston rods 80*b*, 82*b*. Piston rods 78*b*, 80*b*, 82*b* are connected together at a central pivot 84. When cylinders 78, 80, 82 are all extended, pivoting support member 72 will be raised from the position shown in FIG. 4 to the position shown in FIG. 7 while mattress 16 is supported by both member 72 along a central portion thereof and by structure disposed between conveyors 12, 14 along an edge thereof as further discussed below. Pivoting member 72 is pivoted past 90° (vertical) by 10°–20° to provide for fast, automatic flipping requiring little or no operator intervention.

Figure 8:
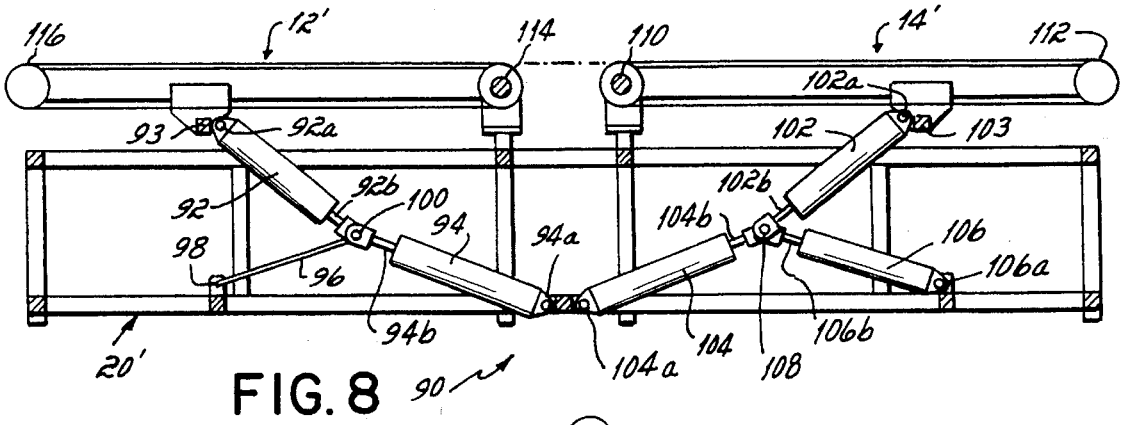
FIG. 8 is a schematic side elevational view of an alternative embodiment of the mattress flipping mechanism shown in a lowered position; and, FIG. 9 is a schematic side elevational view of the apparatus shown in FIG. 8 but showing the flipping mechanism in a raised position.
Figure 9:
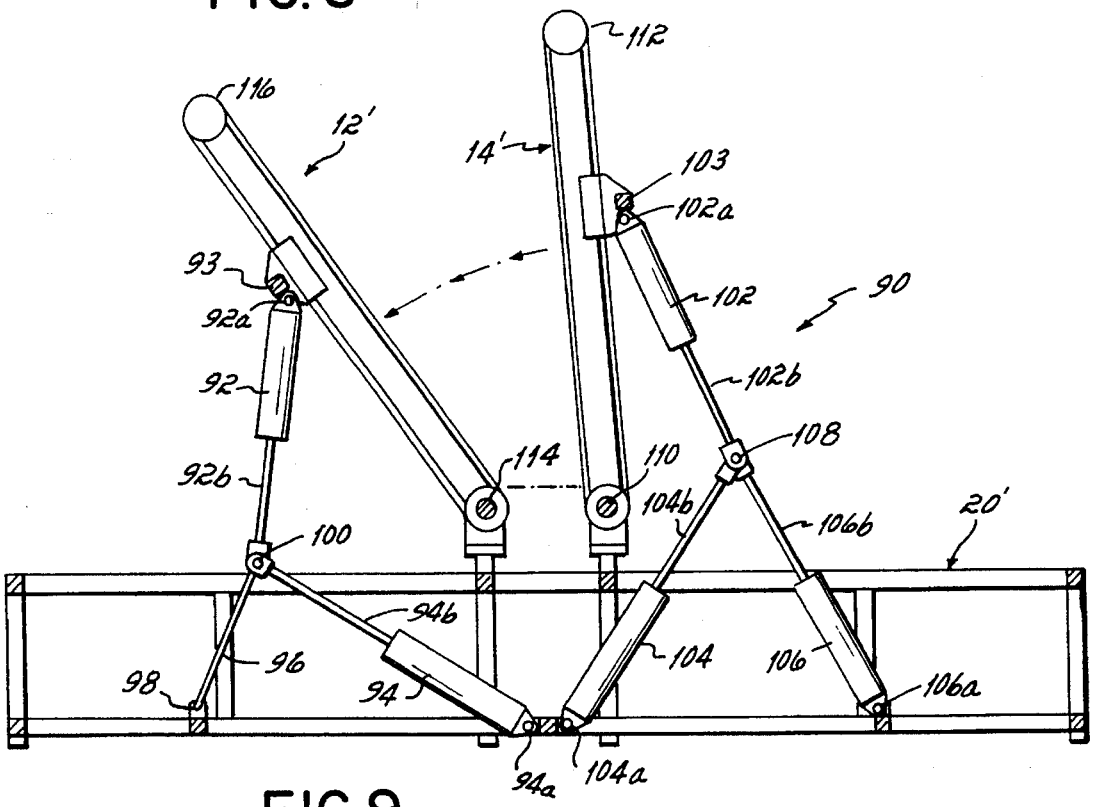

FIGS. 8 and 9 illustrate an alternative flipping mechanism 90 wherein rather than having a pivoting support member perform the flipping operation, the downstream conveyor 14' is raised and flips the mattress onto the upstream conveyor 12'. The upstream conveyor 12' is shown as being partially raised in order to receive the mattress, however, it may remain lowered during the flipping operation as does downstream conveyor 14 in the first embodiment. As another alternative, the arrangement shown in FIGS. 8 and 9 may be reversed such that upstream conveyor 12' is the flipping conveyor and downstream conveyor 14' is the receiving conveyor as in the first embodiment.

As illustrated, flipping mechanism 90 specifically includes a pair of double acting pneumatic cylinders 92, 94 having their respective cylinder ends 92*a*, 94*a* pivotally connected to conveyor 12' and frame 20 and having their respective piston rods 92*b*, 94*b* pivotally connected at 100 to one end of a rod 96. More specifically, cylinder end 92*a* is connected to a support 93 rigidly affixed to conveyor 12' but allowing unobstructed movement of belt 12*a*' with respect thereto. The opposite end of rod 96 is connected to frame 20 by a pivot attachment 98 as shown in FIGS. 8 and 9. Cylinders 92, 94 and rod 96 are generally centrally disposed relative to the length and width of conveyor 12' such that conveyor 12' is centrally supported during a flipping operation.

Flipping mechanism 90 further includes, for example, three double acting pneumatic cylinders 102, 104, 106 for raising and lowering downstream conveyor 14'. Cylinders 102, 104, 106 are similarly arranged to cylinders 78, 80, 82 of the first embodiment. Cylinder 102 has one end 102*a* pivotally attached to conveyor 14' by way of a rigid support 103 extending from an underside thereof but allowing free movement of conveyor belt 14*a*' as with support 93 of conveyor 12'. Cylinder 102 includes a movable piston rod 102*b* at the other end. Cylinders 104, 106 are each pivotally attached at 104*a*, 106*a* to frame 20 and include piston rods 104*b*, 106*b*. Piston rods 102*b*, 104*b*, 106*b* are connected together at a central or common pivot 108.

As cylinders 102, 104, 106 are all extended, conveyor 14' will be rotated about an inner end 112 thereof which is pivotally connected to frame 20' and the free end 114 thereof will be raised from the position shown in FIG. 8 to the position shown in FIG. 9. While the mattress is being raised, it will be supported by both conveyor 14' and by structure disposed between conveyors 12', 14' which is discussed below. Conveyor 14' is moved past 90° (vertical) by 10°–20° as is pivoting member 72 in the first embodiment. At the same, cylinders 92, 94 are extended to the positions shown in FIG. 9 such that conveyor 12' rotates about an inner end 114 thereof which is pivotally connected to frame 20' while the free end 116 thereof is raised approximately 60° to the horizontal so that the mattress is gently received by conveyor 12'.

The Mattress Elevating Mechanism

Referring again to FIGS. 2 and 3, the present invention further incorporates a plurality of mattress elevating units 120, 122, 124 disposed between conveyors 12 and 14. Depending on the size and orientation of mattress 16 on conveyors 12, 14, one of the mattress elevating units 120, 122, 124 is activated to raise the edge of mattress 16 opposite to the edge being sewn. For example, unit 120 may be activated when the long side of a twin sized mattress is being sewn. Unit 122 may be activated when a long side of a queen sized mattress is being sewn and unit 124 may be activated when a short side, i.e., an end of a queen sized mattress is being sewn. Unit 124 may also be activated when any side of a king sized mattress is being sewn (as shown in FIG. 2) or when an end or short side of a twin sized mattress is being sewn. As shown in FIG. 1, elevation of the appropriate unit 120, 122 or 124 causes creases 17 to form slack in the top panel 16*c* of mattress 16 to enable an operator to grasp top panel 16*c* and simply pinch together top panel 16*c* and side panel 16*d* of mattress 16 as upper peripheral edge 16*a* is taped and sewn by machine 18.

Figure 5:
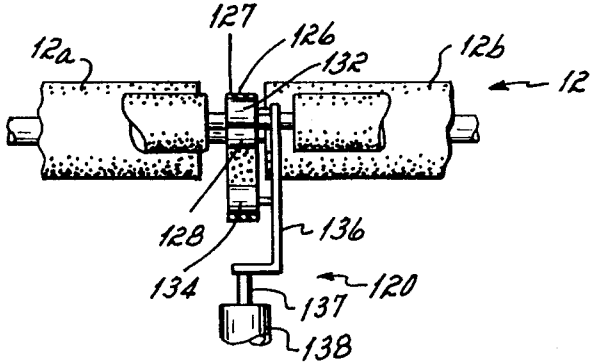
FIG. 5 is cross sectional view of the apparatus taken along line 5—5 of FIG. 4 and showing the mattress creasing or elevating mechanism thereof.

Elevating unit 120 is shown in greater detail in FIGS. 4 and 5. It will be appreciated that elevating units 122 and 124 are constructed identically to elevating unit 120 and therefore only unit 120 will be described herein in detail. Elevating unit 120 essentially comprises a powered endless belt 126 having an upper surface 127 which may be raised from a position substantially level with the upper surfaces of conveyors 12 and 14 to an elevated position, shown in phantom in FIG. 4, which raises mattress 16 and creates creases or slack 17 in upper surface 16*c* (FIG. 1). Belt 126 is powered such that it moves in the direction of conveyors 12, 14 to move the mattress as it is being raised. This maintains uniform movement of the mattress despite the fact that portions of the mattress will lose contact with conveyors 12, 14 as the mattress is elevated. The outer surface of belt 126 has a coefficient of friction sufficient to move a mattress in the direction of movement of conveyors 12, 14 during elevation thereof.

As further shown in FIG. 4, belt 126 passes around drive rollers 128, 130 which may be coupled to the respective rollers 129, 131 used to drive conveyors 12, 14 in a conventional manner. As shown in FIGS. 4 and 5, elevating unit 120 includes a pair of elevating rollers 132, 134 which need not be driven but which are coupled by a connecting bar 136 attached to the piston rod 137 of a double acting pneumatic cylinder 138. Cylinder 138 is connected to frame 20 by a suitable bracket 140. It will be appreciated that when piston rod 137 of cylinder 138 is extended, belt 126 and, more particularly, upper surface 127 thereof will be raised with respect to conveyors 12, 14 to the position shown in phantom in FIG. 4 as belt 126 is continuously driven by rollers 128, 130. This maintains conveyance of mattress 16 (FIG. 1) past sewing machine 18 while creating creases or slack 17 in upper surface 16*c* such that upper surface 16*c* and side surface 16*d* may be easily pinched together along upper edge 16*a* as they are fed into sewing machine 18.

Operation

Referring first to FIG. 1, mattress 16 is supported on upstream conveyor 12 and downstream conveyor 14 in preparation for a sewing and taping operation to be performed on upper peripheral edge 16*a* thereof. After mattress 16 has been positioned approximately as shown in FIG. 1, i.e., with sewing machine 18 disposed about midway along side panel 16*d*, the operator starts the sewing operation. Specifically, as shown in FIG. 2, the appropriate elevating unit 120, 122, or 124 is activated to create slack 17 (FIG. 1) in the top panel 16*c* and the sewing machine 18 is properly engaged with upper peripheral edge 16*a*. In the example shown, elevating unit 124 is activated and raised. At about the same time, guide arm 28 may be moved to the position shown in phantom in FIG. 2. Referring again to FIG. 1, the operator starts conveyors 12, 14, belts 26 and sewing machine 18 while simultaneously pinching together top panel 16*c* and side panel 16*d* at peripheral edge 16*a*. Mattress 16 moves from left to right as viewed in FIG. 1 and, at each corner thereof, side rail 24 is automatically activated to turn the mattress 16 during the corner sewing operation.

When the entire upper peripheral edge 16*a* has been sewn and mattress 16 has therefore returned to the approximate position shown in FIG. 1, mattress 16 is ready to be flipped over such that the same sewing and taping operation may be performed on the opposite peripheral edge. To prepare for the flipping operation, sewing machine 18 and guide arm 28 are moved out of the way and elevating units 120, 122, 124 are set in lowered positions as shown in FIG. 3. Referring to FIG. 4, mattress 16 is moved onto conveyor 12 by reversing the motion of conveyors 12, 14 and belts 26 until mattress 16 is in the position shown. Then, as shown in FIG. 7, mattress flipping mechanism 70 is activated to lift mattress 16 supported centrally by support member 72 and along one end thereof by elevating units 120, 122, 124. The mattress is then flipped over onto downstream conveyor 14 and flipping mechanism 70 is retracted to the position shown in FIG. 4. Conveyors 12, 14 are then reversed to again move mattress 16 approximately to the position shown in FIG. 1 such that a sewing and taping operation may be performed on the opposite peripheral edge.

It will be appreciated that the same general operation takes place while utilizing flipping mechanism 90 shown in FIGS. 8 and 9, except that with the alternative flipping mechanism 90 shown mattress 16 would be flipped from downstream conveyor 14' to upstream conveyor 12'. Of course, either system may be designed to flip a mattress from either conveyor to the other and in each case the mattress will nevertheless need to be moved to an appropriate starting position before the sewing operation begins.

It will be appreciated that while a preferred embodiment of the invention and its several aspects has been described many modifications thereof will be readily recognized by those of ordinary skill. Most notably, powered devices other than those shown may be utilized to flip the mattress and/or elevate the mattress to create slack in the top panel. Other modifications and substitutions will become readily apparent upon review of this disclosure and applicant therefore intends to be bound only by the scope of the appended claims.

What is claimed is:

1. Mattress handling apparatus comprising:

a mattress support including a conveyor for conveying a mattress lying on a first major face thereof while a sewing operation is performed on said mattress;

a mattress flipping mechanism operatively connected to said mattress support for flipping said mattress from said first major face to a second major face thereof after completion of said sewing operation; and, wherein said conveyor is a split conveyor having separate conveying elements and said mattress flipping mechanism comprises a pivoting support disposed in a space defined between the separate conveying elements of said split conveyor.

2. The mattress handling apparatus of claim 1 wherein said pivoting support is pivotally connected to said mattress support and includes a free end, said pivoting support operatively connected to a lift mechanism for moving said free end of said pivoting support and pivoting said mattress in an upward direction.

3. Mattress handling apparatus comprising:

a mattress support including a conveyor for conveying a mattress lying on a first major face thereof while a sewing operation is performed on said mattress;

a mattress flipping mechanism operatively connected to said mattress support for flipping said mattress from said first major face to a second major face thereof after completion of said sewing operation; and, wherein said conveyor further comprises at least one upstream conveyor and at least one downstream conveyor, and a sewing machine is mounted along one side and substantially between said upstream and downstream conveyors.

4. The mattress handling apparatus of claim 3 wherein said sewing machine is mounted on a pivoted support for allowing said sewing machine to be pivoted toward said mattress support into a mattress engaging sewing position and away from said mattress support into a disengaged position allowing said mattress to be flipped over.

5. The mattress handling apparatus of claim 4 further comprising a fluid powered cylinder operatively connected to said pivoted support for moving said sewing machine between said sewing position and said disengaged position.

6. The mattress handling apparatus of claim 3 further comprising at least one mattress elevating unit mounted between said upstream and downstream conveyors but spaced a predetermined distance from said sewing machine for raising an edge of said mattress opposite to an edge being sewn, said elevating unit thereby creating slack in a top panel of said mattress to enable grasping thereof by an operator during said sewing operation.

7. The mattress handling apparatus of claim 6 further comprising a plurality of mattress elevating units spaced predetermined distances from said sewing machine, wherein said predetermined distances correspond to different mattress length and width dimensions.

8. The mattress handling apparatus of claim 6 wherein said mattress elevating unit further comprises an endless belt member mounted for vertical and rotational movement between said upstream and downstream conveyors.

9. The mattress handling apparatus of claim 8 wherein said endless belt is operatively connected to a drive roller.

10. The mattress handling apparatus of claim 9 wherein said endless belt extends around at least one vertically movable elevating roller connected to a reciprocating vertical drive mechanism.

11. The mattress handling apparatus of claim 10 wherein said mattress elevating unit comprises two drive rollers and two elevating rollers, said elevating rollers being connected to one another and to said reciprocating drive mechanism, said elevating rollers further engaging said endless belt intermediate said two drive rollers.

12. The mattress handling apparatus of claim 1 wherein said conveyor includes a pivoting end and a free end and said mattress flipping mechanism further comprises a powered lift connected to said conveyor for raising said free end with respect to said pivoted end to thereby flip said mattress over.

13. The mattress handling apparatus of claim 12 further comprising at least one upstream conveyor and one downstream conveyor, wherein one of said upstream and said downstream conveyors is connected to said powered lift.

14. The mattress handling apparatus of claim 13 wherein both the upstream and downstream conveyors include pivoted ends disposed generally adjacent to one another and opposite free ends, said upstream and downstream conveyors each being connected to powered lift mechanisms such that with both conveyors being raised a mattress may be flipped from one conveyor onto the other.

15. The mattress handling apparatus of claim 1 further comprising a mattress pivoting arm extending parallel to the direction of movement of said conveyor in one position and pivotal to a second position perpendicular to the direction of movement of said conveyor to pivot said mattress about a corner thereof during an edge sewing operation, said pivoting arm including a mattress guide arm connected along a top edge thereof and movable between a position in which said guide arm contacts an upper face of said mattress and a position spaced away from said mattress a distance sufficient to allow said mattress to be flipped over.

16. Mattress handling apparatus comprising:

a mattress support for supporting a mattress lying on a first major face thereof while a sewing operation is performed with respect to said first major face, said mattress support including at least one powered conveyor operatively connected to said mattress support for conveying said mattress along said mattress support during said sewing operation;

at least one mattress elevating unit operatively connected to said mattress support and spaced a predetermined distance from one side of said mattress support for raising an edge of said mattress opposite to an edge being sewn, said mattress elevating unit thereby creating slack in a top panel of said mattress to enable grasping thereof by an operator; and wherein said mattress support includes upstream and downstream conveyors and said mattress elevating unit is disposed between said upstream and downstream conveyors.

17. The apparatus of claim 16 further comprising a plurality of mattress elevating units disposed between said upstream and downstream conveyors and spaced predetermined distances from said sewing machine, wherein said predetermined distances correspond to different mattress length and width dimensions.

18. The apparatus of claim 16 wherein said mattress elevating unit further comprises an endless belt member mounted for vertical and rotational movement between said upstream and downstream conveyors.

19. The mattress sewing and handling apparatus of claim 18 wherein said endless belt is operatively connected to a drive roller.

20. The mattress sewing and handling apparatus of claim 19 wherein said endless belt extends around at least one vertically movable elevating roller connected to a reciprocating vertical drive mechanism.

21. The mattress sewing and handling apparatus of claim 19 wherein said mattress elevating unit comprises two drive rollers and two elevating rollers, said elevating rollers being connected to one another and to said reciprocating drive mechanism, said elevating rollers further engaging said endless belt intermediate said two drive rollers.

22. Mattress handling apparatus comprising:

a mattress support for supporting a mattress lying on a first major face thereof while a sewing operation is performed with respect to said first major face, said mattress support including at least one powered conveyor operatively connected to said mattress support for conveying said mattress along said mattress support during said sewing operation; and, a mattress pivoting arm extending parallel to the direction of movement of said conveyor in one position and pivotal to a second position perpendicular to the direction of movement of said conveyor to pivot said mattress about a corner thereof during an edge sewing operation, said pivoting arm including a mattress guide arm connected along a top edge thereof and movable between a first position in which said guide arm contacts an upper face of said mattress and a second position spaced away from said mattress.

23. The apparatus of claim 22 wherein said mattress stabilizer is movable to a third position spaced farther away from said mattress than said second position to allow a mattress flipping operation to take place.

24. The apparatus of claim 22 wherein said mattress stabilizer includes a convexly shaped surface for contacting said mattress.

25. A method of sewing peripheral edges of a mattress, the method comprising the steps of:

placing said mattress on a mattress support including upstream and downstream conveyors;

conveying said mattress past a sewing machine mounted along one side and substantially between said upstream and downstream conveyors while sewing a first peripheral edge thereof;

moving said mattress onto a powered mattress flipping mechanism;

activating said mattress flipping mechanism to flip said mattress onto its other side; and, conveying said mattress past said sewing machine while sewing a second peripheral edge thereof.

26. The method of claim 25 further comprising the step of pivoting said sewing machine away from said mattress support before activating said mattress flipping mechanism.

27. The method of claim 25 further comprising the step of elevating a side of said mattress opposite to the side being sewn during each conveying step so as to create slack in a top panel of said mattress to enable grasping thereof by an operator.

28. A method of sewing peripheral edges of a mattress, the method comprising the steps of:

placing said mattress on a mattress support including upstream and downstream conveyors;

conveying said mattress past a sewing machine disposed along one side and substantially between said upstream and downstream conveyors;

sewing a first edge of said mattress while conveying said mattress past said sewing machine; and, elevating a second edge of said mattress opposite to the first edge with a mattress elevating unit disposed between said upstream and downstream conveyors to create slack in a top panel of said mattress.

29. Apparatus for supporting and pivoting a mattress component during a sewing operation comprising:

a support for supporting said mattress component during said sewing operation;

a side rail mounted adjacent said support and extending parallel to a direction of movement of said mattress component during said sewing operation;

a stabilizer member operatively connected to and extending outwardly from said side rail for compressing an upper surface of said mattress component; and, wherein said side rail is pivotal to a position perpendicular to the direction of movement of said mattress component to pivot said mattress component about a corner thereof during said sewing operation.

30. The apparatus of claim 29 wherein said arm is connected to said side rail for movement with respect to said side rail between a first position in which said arm compresses an upper surface of said mattress component and a second position in which said arm does not compress the upper surface of said mattress component.

31. The apparatus of claim 29 wherein said arm includes a convexly shaped lower surface for contacting the upper surface of said mattress component.

32. The apparatus of claim 29 wherein said arm is connected to said side rail by a pair of pivot arms affixed to one another by a connecting rod, said connecting rod being operatively connected to said side rail to allow rotational movement about an axis of said connecting rod and thereby allow pivoting motion of said arm toward and away from said mattress component.

33. The apparatus of claim 32 wherein said connecting rod is operatively connected to said side rail by a bracket secured to said side rail, said bracket including at least one curved slot through which said connecting rod passes.

34. The apparatus of claim 33 further comprising means for pivoting said pair of pivot arms and said connecting rod when said connecting rod is disposed at a lower end of said curved slot.

35. The apparatus of claim 34 wherein said means for pivoting said pair of pivot arms comprises fluid powered cylinders having movable portions thereof respectively attached to said pivot arms.

36. The apparatus of claim 33 further comprising means for moving said connecting rod toward an upper end of said curved slot.

37. The apparatus of claim 36 wherein said means for moving said connecting rod toward an upper end of said curved slot comprises a fluid powered cylinder having a movable portion thereof attached to said connecting rod.

* * * * *

UNITED STATES PATENT AND TRADEMARK OFFICE

CERTIFICATE OF CORRECTION

PATENT NO. : 5,515,796
DATED : May 14, 1996
INVENTOR(S) : Steven E. Ogle et al.

It is certified that error appears in the above-indentified patent and that said Letters Patent is hereby corrected as shown below:

At column 4, line 50, please delete "15".

At column 11, line 35, please replace "guide arm" with --stabilizer--.

Signed and Sealed this
Twenty-eighth Day of January, 1997

*Attest:*

Bruce Lehman

BRUCE LEHMAN

*Attesting Officer*

*Commissioner of Patents and Trademarks*